US008512025B1

(12) United States Patent
Chen

(10) Patent No.: US 8,512,025 B1
(45) Date of Patent: Aug. 20, 2013

(54) CORRUGATING ROLLER PAIR SUPPORT FRAME

(76) Inventor: Tien-Yang Chen, New Taipei (TW)

( * ) Notice: Subject to any disclaimer, the term of this patent is extended or adjusted under 35 U.S.C. 154(b) by 38 days.

(21) Appl. No.: 13/418,245

(22) Filed: Mar. 12, 2012

(51) Int. Cl.
*B30B 3/00* (2006.01)
*B31F 1/20* (2006.01)

(52) U.S. Cl.
USPC ..... 425/186; 425/183; 425/194; 425/369; 156/462; 493/463; 493/477

(58) Field of Classification Search
USPC ..... 425/183, 186, 193, 194, 336, 369; 156/462; 493/463, 477
See application file for complete search history.

(56) References Cited

U.S. PATENT DOCUMENTS 2,308,040 A * 1/1943 Anderson ..... 425/194
2,687,165 A * 8/1954 Hollis ..... 425/369
4,627,831 A * 12/1986 Hirakawa et al. ..... 493/463
6,238,198 B1 * 5/2001 Hatasa et al. ..... 425/186

* cited by examiner

*Primary Examiner* — James Mackey
(74) *Attorney, Agent, or Firm* — WPAT, P.C.; Anthony King

(57) ABSTRACT

A corrugating roller pair support frame includes four supporting posts, in between two of which one rectangular supporting plate of a corrugating roller pair is mounted while another rectangular supporting plate is mounted in between the other two supporting posts, and the four supporting posts having a plurality of locating blocks movably embedded therein for releasably engaging with locating slots formed on the rectangular supporting plates to thereby releasably hold the corrugating roller pair to the support frame; and a supporting elevator for supporting and regulating the corrugating roller pair to a desired height on the support frame. With these arrangements, the corrugating roller pair can be conveniently mounted to or released from the support frame and be easily exchanged with another one, so that the time needed for handling the corrugating roller pair is shortened and the efficiency of manufacturing corrugated boards is upgraded.

7 Claims, 15 Drawing Sheets

CORRUGATING ROLLER PAIR SUPPORT FRAME

FIELD OF THE INVENTION

The present invention relates to a corrugating roller pair support frame, and more particularly to a corrugating roller pair support frame that enables easy mounting and releasing of a corrugating roller pair to and from a corrugating machine and easy exchange of one corrugating roller pair with another one, so that the time needed to handle the corrugating roller pair is shortened and the efficiency of manufacturing corrugated boards is upgraded.

BACKGROUND OF THE INVENTION

With its special structure and relatively good structural strength, corrugated board has been widely used in many applications, such as creation of art works, formation of paper-made advertisements, or even manufacturing of furniture. A conventional corrugating machine for producing corrugated board mainly includes a corrugating roller pair, which must be preheated before being used to form corrugated board. When using the same corrugating machine to produce another type of corrugated board, the whole corrugating machine must stop operating, the original corrugating roller pair is dismounted from the corrugating machine, and another required corrugating roller pair is mounted on the corrugating machine. Again, the newly mounted corrugating roller pair must be preheated before the corrugating machine can be started for operating. The corrugating roller pair is very heavy, and it is time and energy consuming to release the same from the corrugating machine and mount another one to replace it. Further, it takes time to preheat the newly mounted corrugating roller pair to thereby extend the operating time.

It is therefore tried by the inventor to develop a structure that enables easy mounting or releasing of the corrugating roller pair to or from the corrugating machine, so that the time needed for exchanging two corrugating roller pairs can be shortened to upgrade the efficiency of producing corrugated board.

SUMMARY OF THE INVENTION

A primary object of the present invention is to provide a corrugating roller pair support frame that enables easy mounting or releasing of a corrugating roller pair to or from a corrugating machine and easy exchange of one corrugating roller pair with another one to shorten handling time and upgrade production efficiency.

To achieve the above and other objects, the corrugating roller pair support frame according to the present invention is designed for at least one corrugating roller pair of a corrugating machine to easily releasably mount thereto. The corrugating roller pair includes two rectangular supporting plates and two corrugating rollers. The two corrugating rollers are arranged side by side and rotatably connected to between the two rectangular supporting plates; and the two rectangular supporting plates are respectively formed on each of two lateral sides with at least one locating slot. The corrugating roller pair support frame according to the present invention includes four supporting posts, in between two of which one rectangular supporting plate of the corrugating roller pair is mounted while another rectangular supporting plate is mounted in between the other two supporting posts, and the four supporting posts having a plurality of locating blocks movably embedded therein for releasably engaging with locating slots formed on the rectangular supporting plates to thereby releasably hold the corrugating roller pair to the support frame; and a supporting elevator for supporting and regulating the corrugating roller pair to a desired height on the support frame.

With these arrangements, the corrugating roller pair can be conveniently mounted to or released from the support frame and be easily exchanged with another one, so that the time needed for handling the corrugating roller pair is shortened and the efficiency of manufacturing corrugated boards is upgraded.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and with reference to the accompanying drawings.

Figure 1:
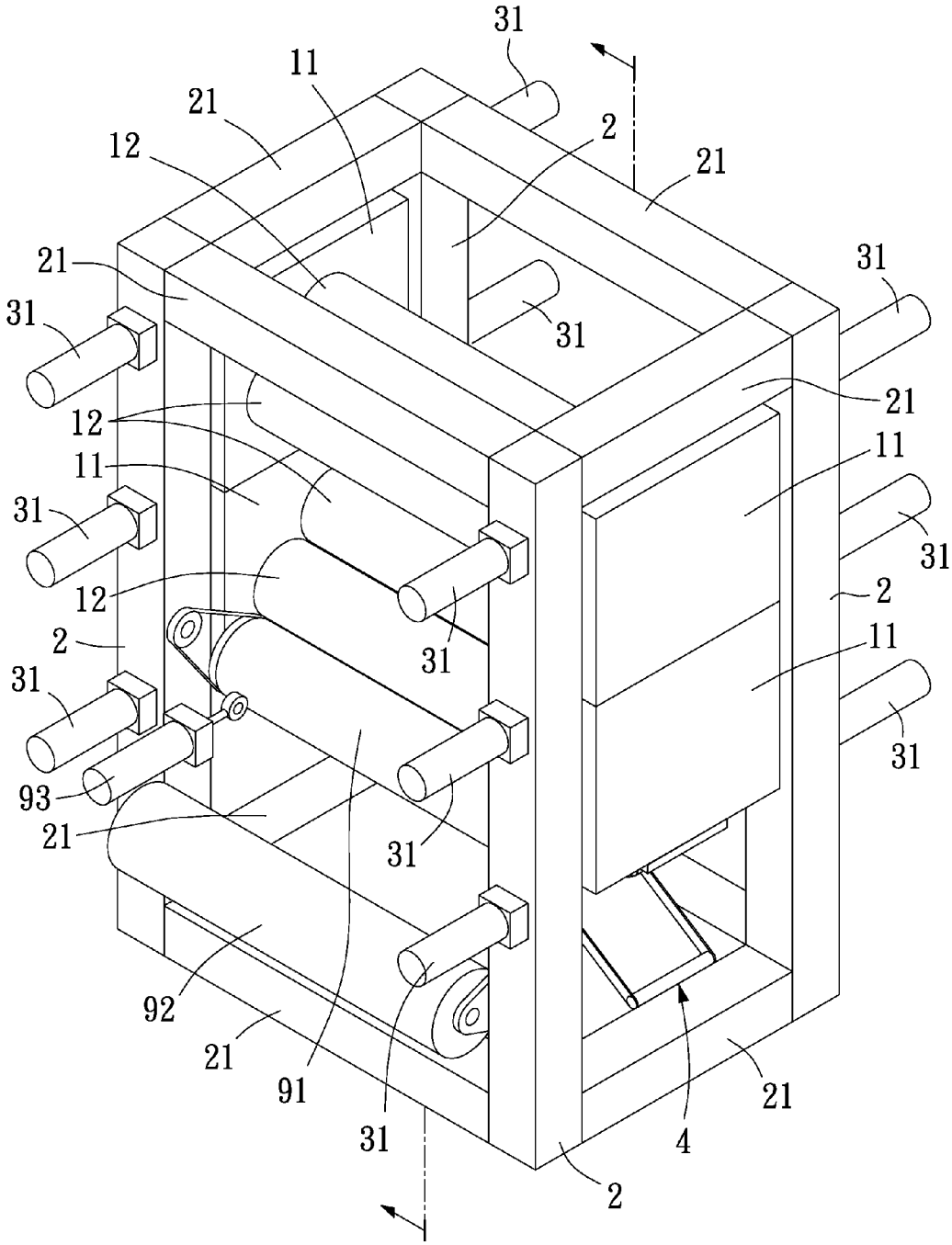
FIG. 1 is a schematic perspective view of a corrugating roller pair support frame according to an embodiment of the present invention.
Figure 2:
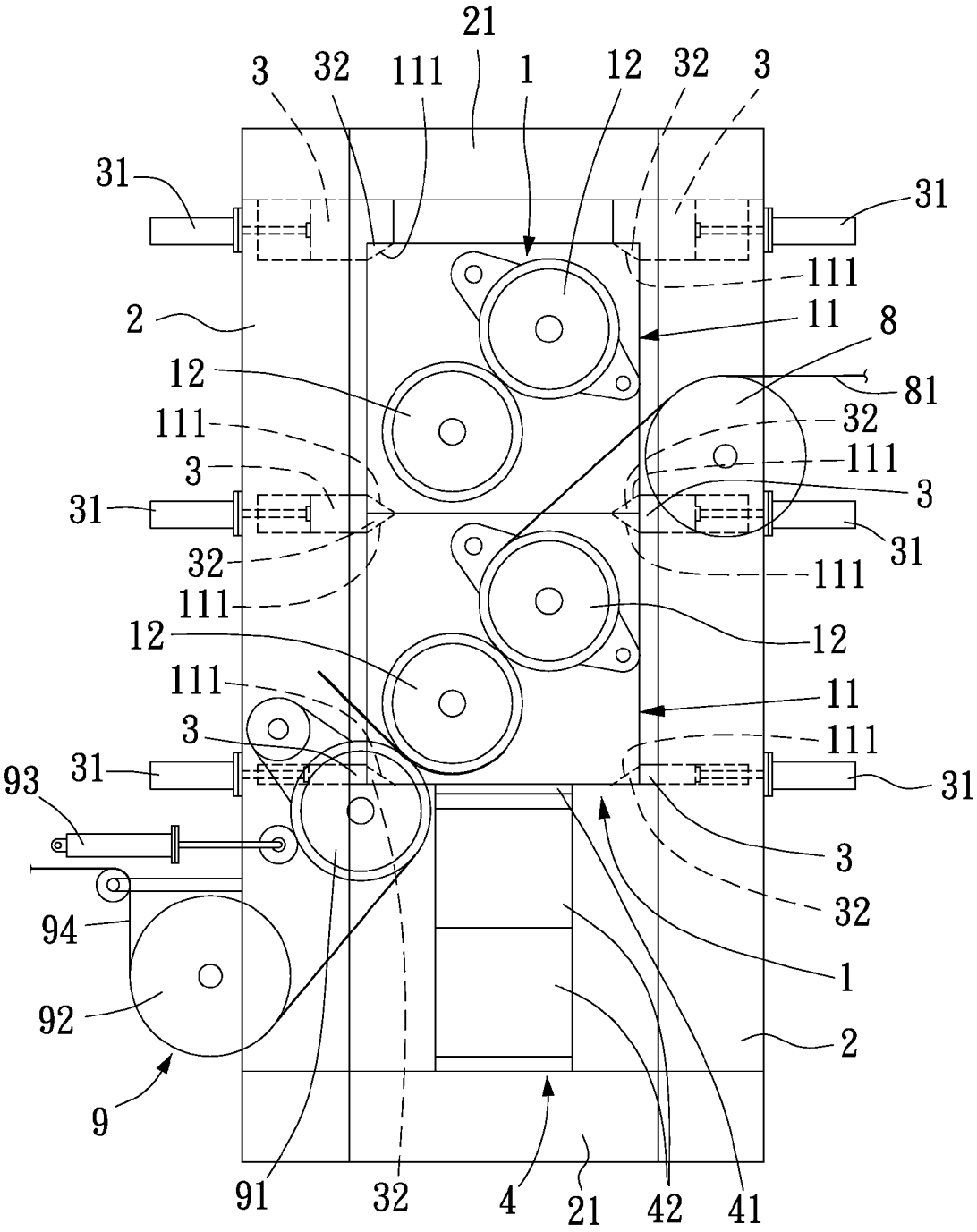
FIGS. 2 to 10 are left-side sectional views of the corrugating roller pair support frame of the present invention showing the use thereof.
Figure 12:
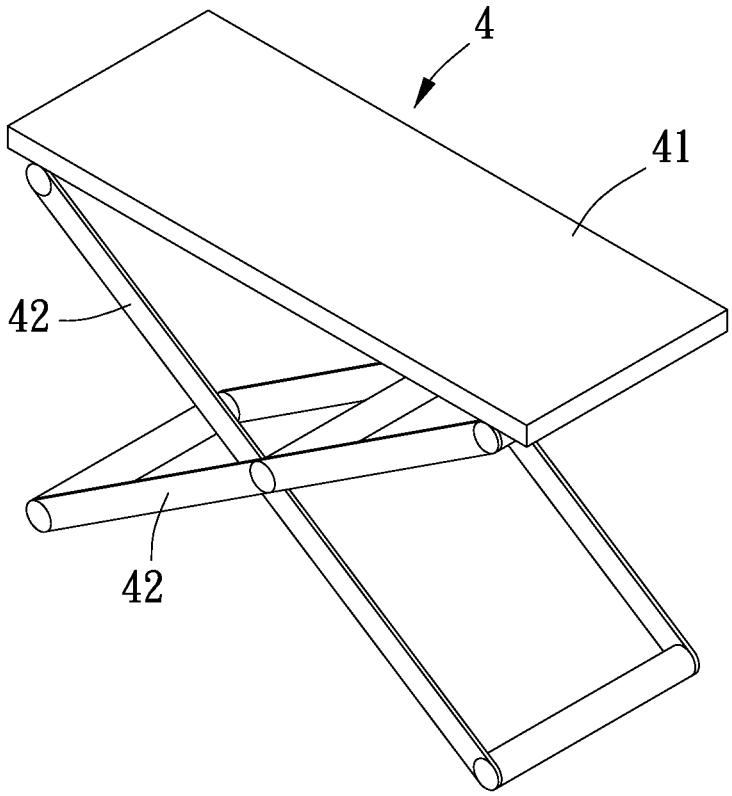
FIG. 12 is a perspective view of a supporting elevator for the corrugating roller pair support frame of the present invention.

Please refer to FIG. 1 that is a schematic perspective view of a corrugating roller pair support frame according to a preferred embodiment of the present invention, and to FIG. 2 that is a left-side sectional view showing the use of the present invention. As shown, the corrugating roller pair support frame is laterally symmetrically configured, and FIG. 2 is a sectional view taken along a middle position of the support frame of FIG. 1 and viewed from the middle position toward a left side of the support frame. The corrugating roller pair support frame of the present invention is configured for releasably holding at least one corrugating roller pair 1 for a corrugating machine. In the illustrated embodiment, there are two corrugating roller pairs 1 held on the support frame. Each of the corrugating roller pairs 1 includes two rectangular supporting plates 11 and two corrugating rollers 12. FIG. 2 shows only the rectangular supporting plates 11 located at the left side of the support frame. The rectangular supporting plates 11 located at the right side of the support frame are not shown in FIG. 2 but they are symmetrically identical to the left supporting plates 11. Further, the corrugating rollers 12 as shown in FIG. 2 are located with their longitudinal axes perpendicular to a plane containing the drawing sheet. The two corrugating rollers 12 are arranged side by side and are so positioned that a plane passing through their central axes and a horizontal plane contain a 45-degree angle therebetween. The two corrugating rollers 12 are rotatably connected to between the two rectangular supporting plates 11, i.e. a left and a right rectangular supporting plate 11. The rectangular supporting plates 11 may be respectively a cuboid or a cube. At least one locating slot 111 is formed on each of two lateral sides of the rectangular supporting plates 11 for preventing the roller pair 1 from moving sidewardly. In the embodiment illustrated in FIG. 2, there are four locating slots 111 separately formed at four corners of the rectangular supporting plate 11 to locate between two opposite surfaces of the supporting plate 11. Alternatively, the locating slots 111 may be formed on two in-facing surfaces or two out-facing surfaces of the left and right rectangular supporting plates 11 of the corrugating roller pair 1. The support frame includes four supporting posts 2 and a supporting elevator 4. FIG. 2 shows only the two supporting posts 2 located at the left side of the support frame. The two supporting posts 2 located at the right side of the support frame are not shown in FIG. 2 but they are symmetrically identical to the left supporting posts 2. In FIG. 2, only the left side of the supporting elevator 4 is shown. However, a complete structure of the supporting elevator 4 is shown in FIG. 12. The supporting posts 2 are respectively provided with a plurality of movable locating blocks 3. Again, FIG. 2 only shows the locating blocks 3 provided in the two left-side supporting posts 2, and the locating blocks 3 provided in the two right-side supporting posts 2 are not shown but they are symmetrically identical to the left-side locating blocks 3. The four supporting posts 2 may be square or round posts, and may be independently fixedly mounted to a floor or be connected to one another via a plurality of transverse connecting members 21 before being fixedly mounted to the floor. The two left-side rectangular supporting plates 11 of the corrugating roller pair 1 are located in between the two left-side supporting posts 2, and the two right-side rectangular supporting plates 11 of the corrugating roller pair 1 are located in between the two right-side supporting posts 2. While FIG. 2 only shows the manner in which the left-side rectangular supporting plates 11 are fitted in between the two left-side supporting posts 2, the right-side rectangular supporting plates 11 are similarly fitted in between the two right-side supporting posts 2. The locating blocks 3 are movably embedded in the supporting posts 2. While FIG. 2 only shows the manner in which the locating blocks 3 are embedded in the two left-side supporting posts 2, the locating blocks 3 are embedded in the two right-side supporting posts 2 in the same manner. When the locating blocks 3 engage with the locating slots 111 on the rectangular supporting plates 11, the corrugating roller pair 1 is firmly held to the support frame. On the other hand, when the locating blocks 3 are disengaged from the locating slots 111, the corrugating roller pair 1 can be released from the support frame. The supporting elevator 4 serves to support the corrugating roller pairs 1 and regulate the same to different heights on the support frame.

Figure 3:
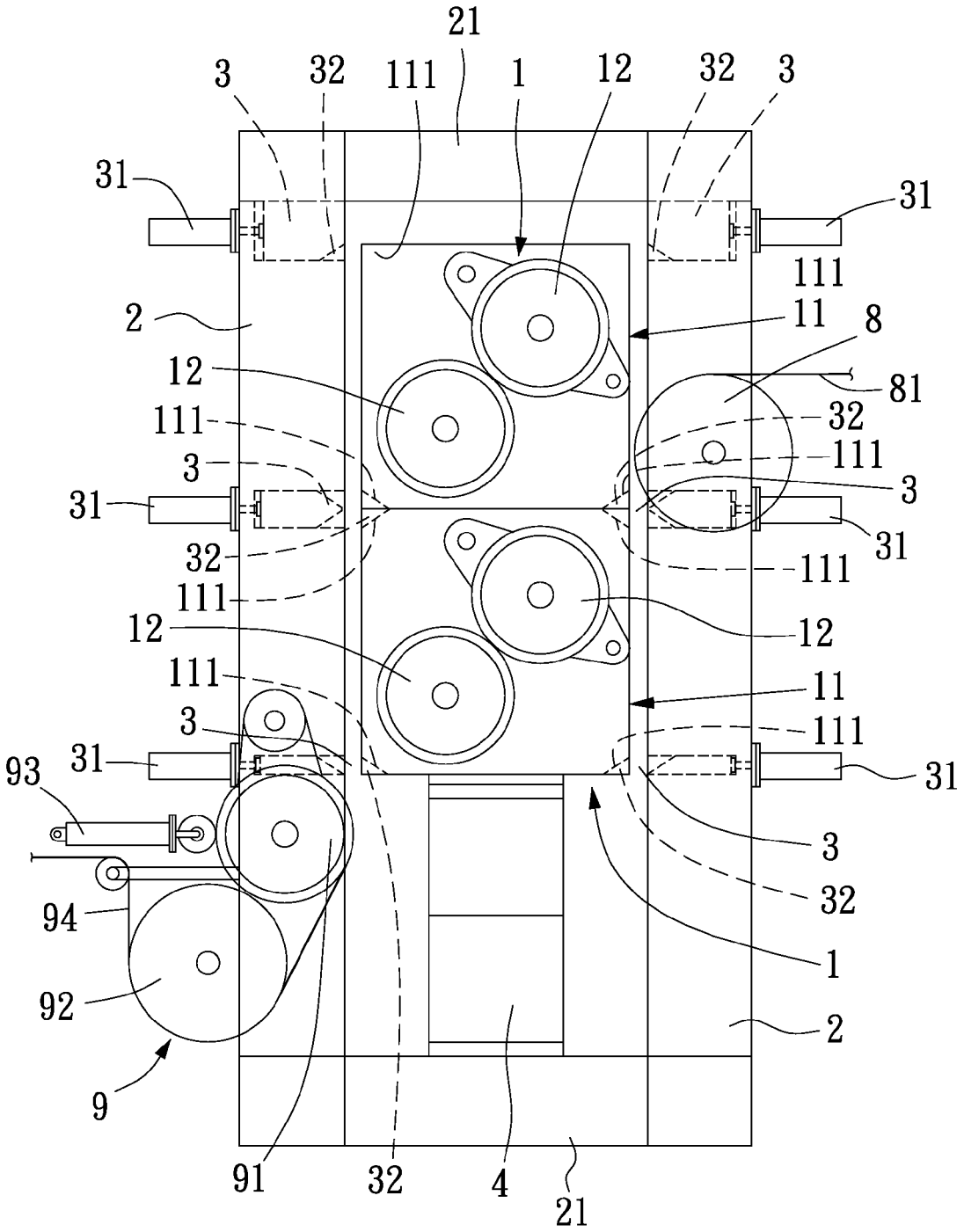
Figure 4:
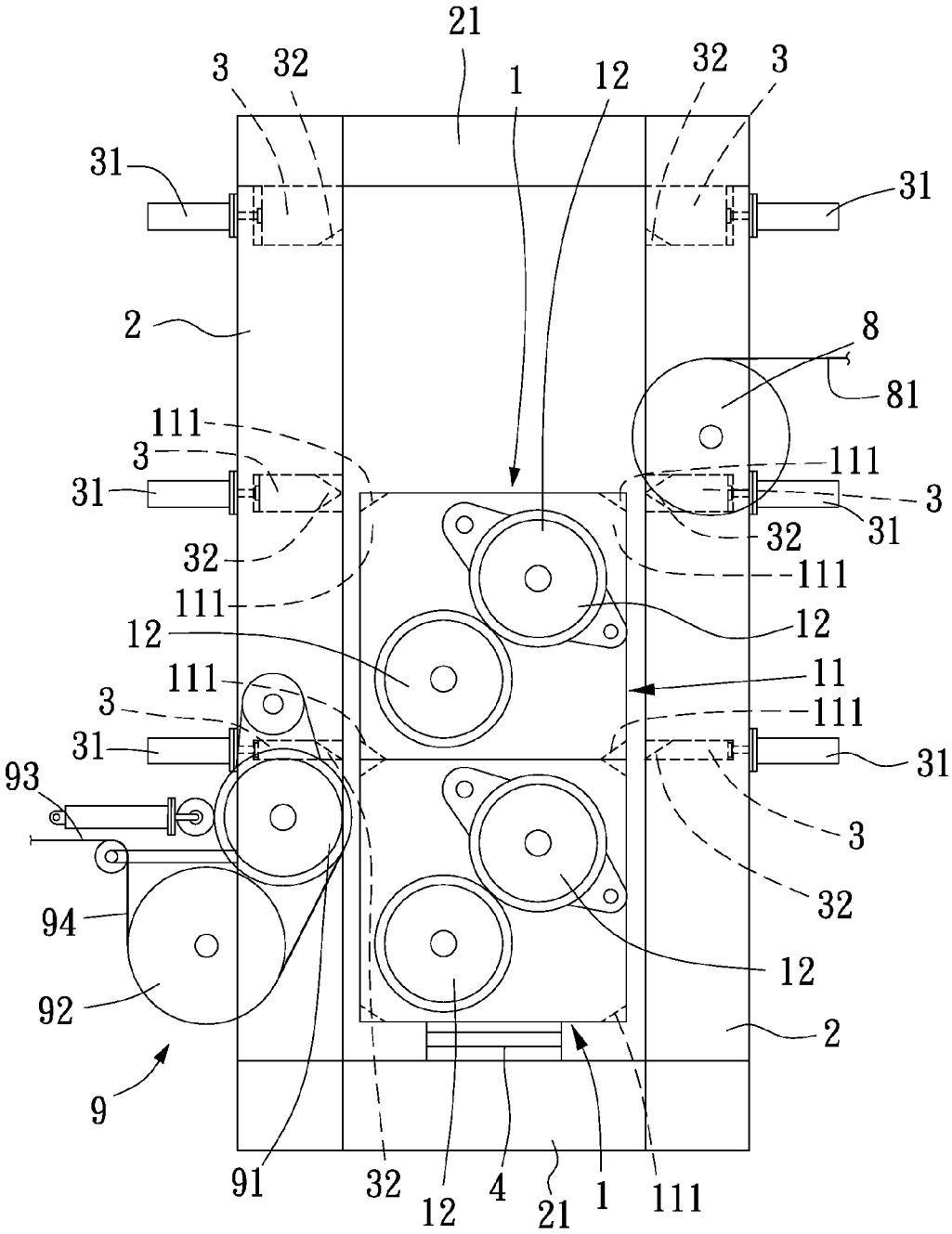
Figure 5:
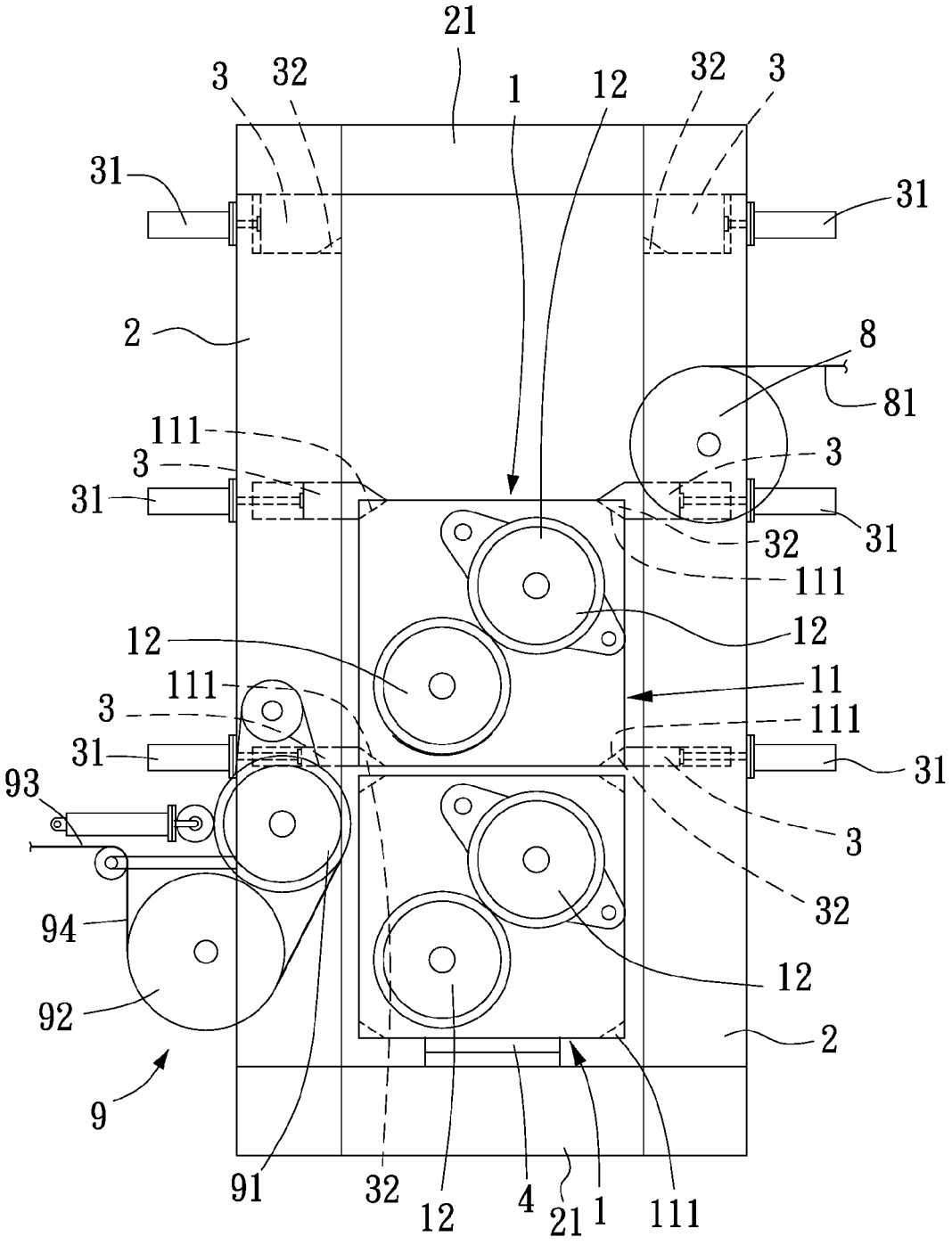
Figure 6:
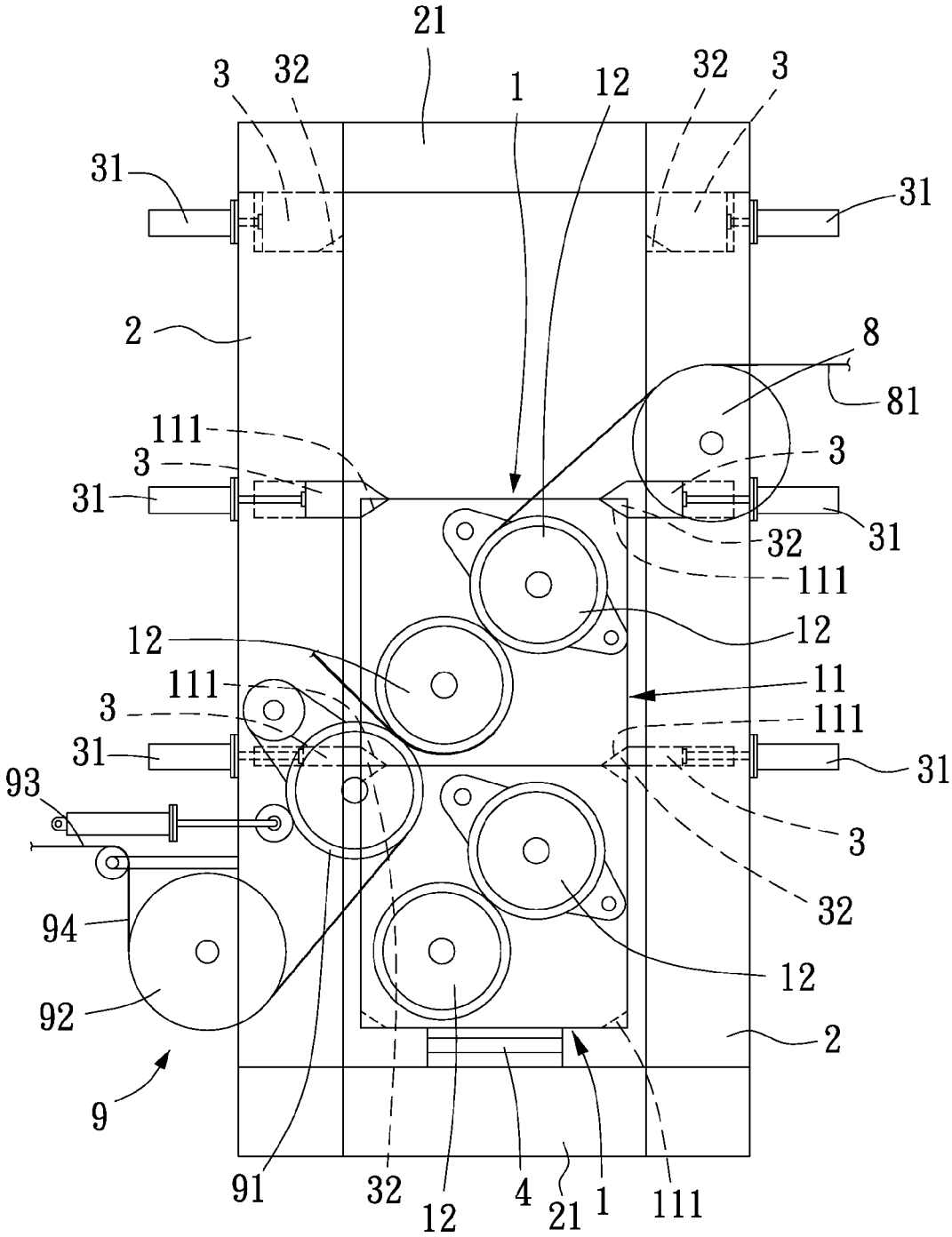

FIGS. 2 to 6 show the use of the corrugating roller pair support frame of the present invention. Please refer to FIGS. 2 to 6 along with FIG. 1. As shown, the corrugating roller pair support frame of the present invention is laterally symmetrically configured, and FIGS. 2 to 6 are sectional views taken along a middle position of the support frame of FIG. 1 and viewed from the middle position toward the left side of the support frame. Herein, the support frame will be described with two corrugating roller pairs 1 vertically superposed therein. As can be seen in FIG. 2, when the corrugating machine operates, one of the corrugating roller pairs 1 located at a lower position is now in a working zone. A first feeding roller 8 is also arranged on the support frame of the present invention for feeding a first paper material 81 to between the two corrugating rollers 12 of the lower corrugating roller pair 1, so that the first paper material 81 is pressed to form corrugations thereon. Meanwhile, a feeding mechanism 9 having a second feeding roller 91, a third feeding roller 92 and a driving unit 93 is also arranged on the support frame of the present invention. The first feeding roller 8, the two corrugating rollers 12 of the lower corrugating roller pair 1 in the working zone, the second feeding roller 92, and the third feeding roller 92 are so positioned that a plane passing through their central axes and a horizontal plane contain a 45-degree angle therebetween. The driving unit 93 of the feeding mechanism 9 drives the second feeding roller 91 to locate closely below the corrugating rollers 12 of the lower corrugating roller pair 1, and the third feeding roller 92 feeds a second paper material 94 to between the corrugating rollers 12 of the lower corrugating roller pair 1 and the second feeding roller 91 while glue is applied onto the second paper material 94. Finally, the second paper material 94 and the corrugated first paper material 81 are heated and bonded to each other to form a corrugated board, which is then output from the corrugating machine. Meanwhile, the two corrugating rollers 12 of the upper corrugating roller pair 1 are preheated. As shown in FIG. 3, in the event the lower corrugating roller pair 1 in the working zone of the support frame is disordered or when a different type of corrugated board is to be manufactured on the corrugating machine, and it is therefore necessary to replace the lower corrugating roller pair 1 with another one, the first feeding roller 8 and the second feeding roller 91 are caused to stop feeding paper materials, the driving unit 93 of the feeding mechanism 9 drives the second feeding roller 91 to move backward away from the corrugating rollers 12 of the lower corrugating roller pair 1, and all the locating blocks 3 are caused to retract into the supporting posts 2. Then, as shown in FIG. 4, the supporting elevator 4 lowers the two corrugating roller pairs 1, so that the upper corrugating roller pair 1 is now located in the working zone. Further, as shown in FIG. 5, the locating blocks 3 within the working zone are caused to protrude from the supporting posts 2 into the locating slots 111 on the supporting plates 11 of the upper corrugating roller pair 1, so that the upper corrugating roller pair 1 in the working zone is firmly held to the support frame. On the other hand, the lower corrugating roller pair 1 is further lowered by the supporting elevator 4 and then horizontally moved (perpendicular to the drawing sheet) by a horizontal exchange platform (not shown) to exchange position with another preheated corrugating roller pair 1, which is then moved onto the supporting elevator 4. Thereafter, as shown in FIG. 6, the supporting elevator 4 elevates the replacing corrugating roller pair 1, the driving unit 93 of the feeding mechanism 9 drives the second feeding roller 91 to locate closely below the corrugating rollers 12 of the upper corrugating roller pair 1, and the first feeding roller 8 and the second feeding roller 91 start feeding paper materials for manufacturing corrugated board.

Figure 7:
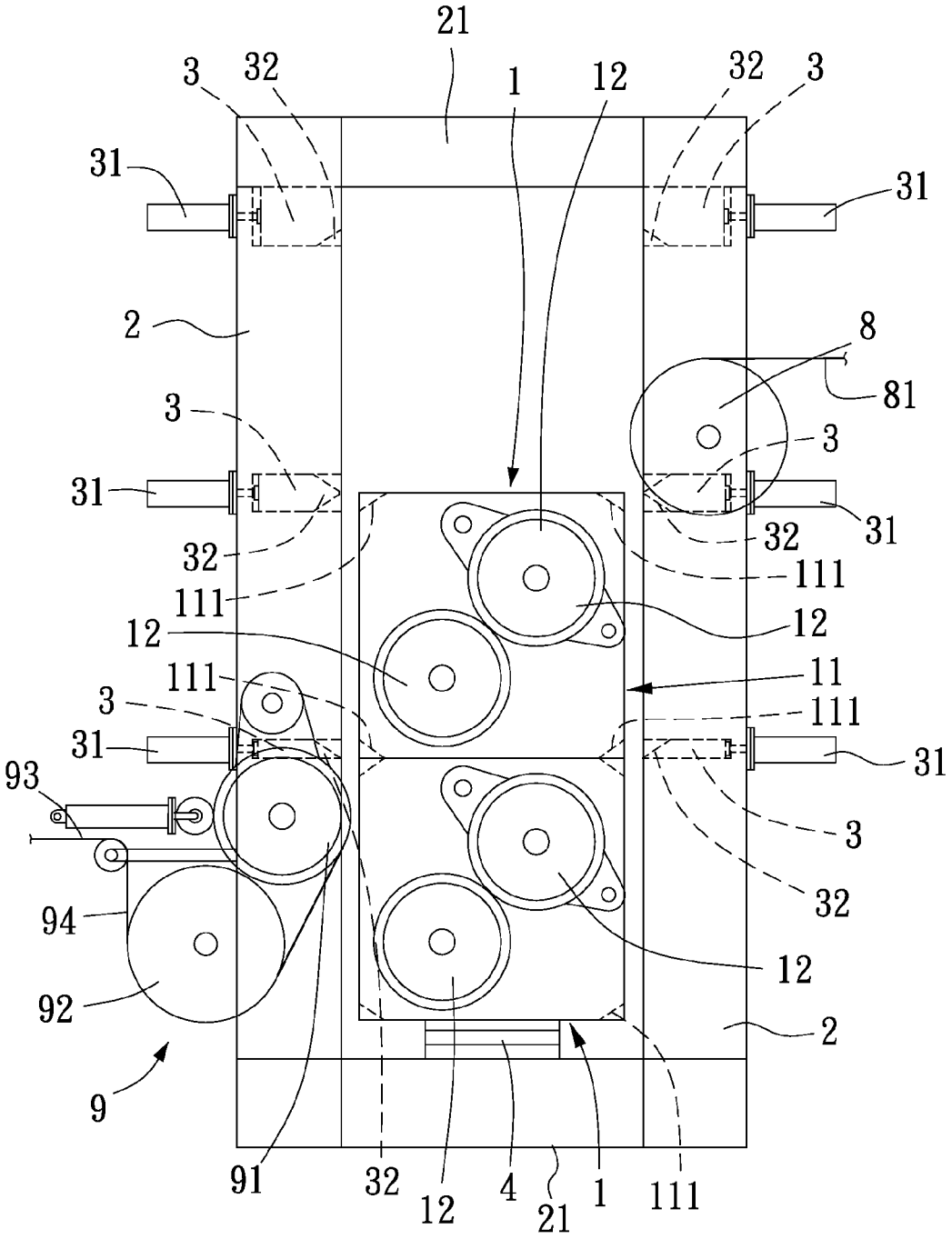
Figure 8:
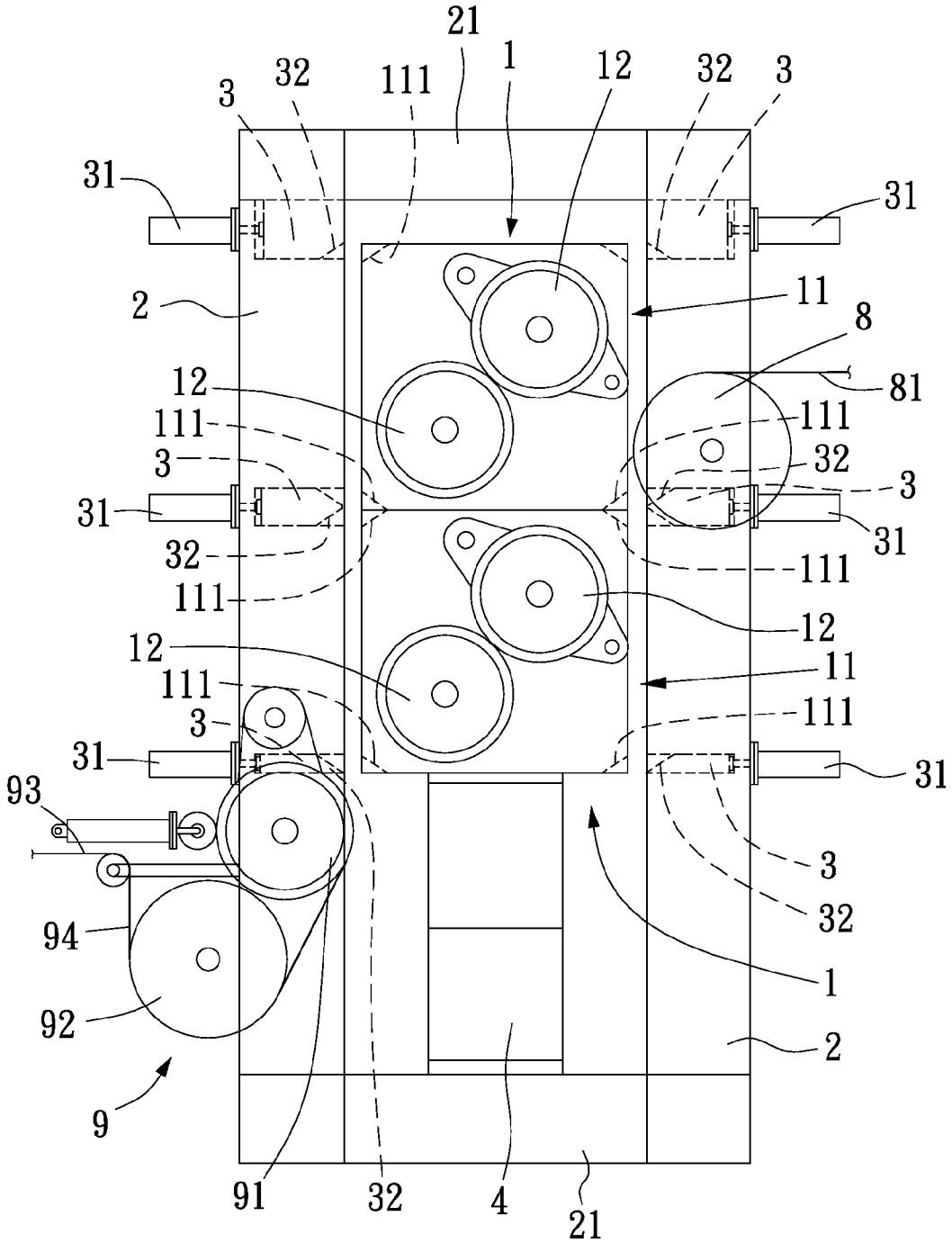
Figure 9:
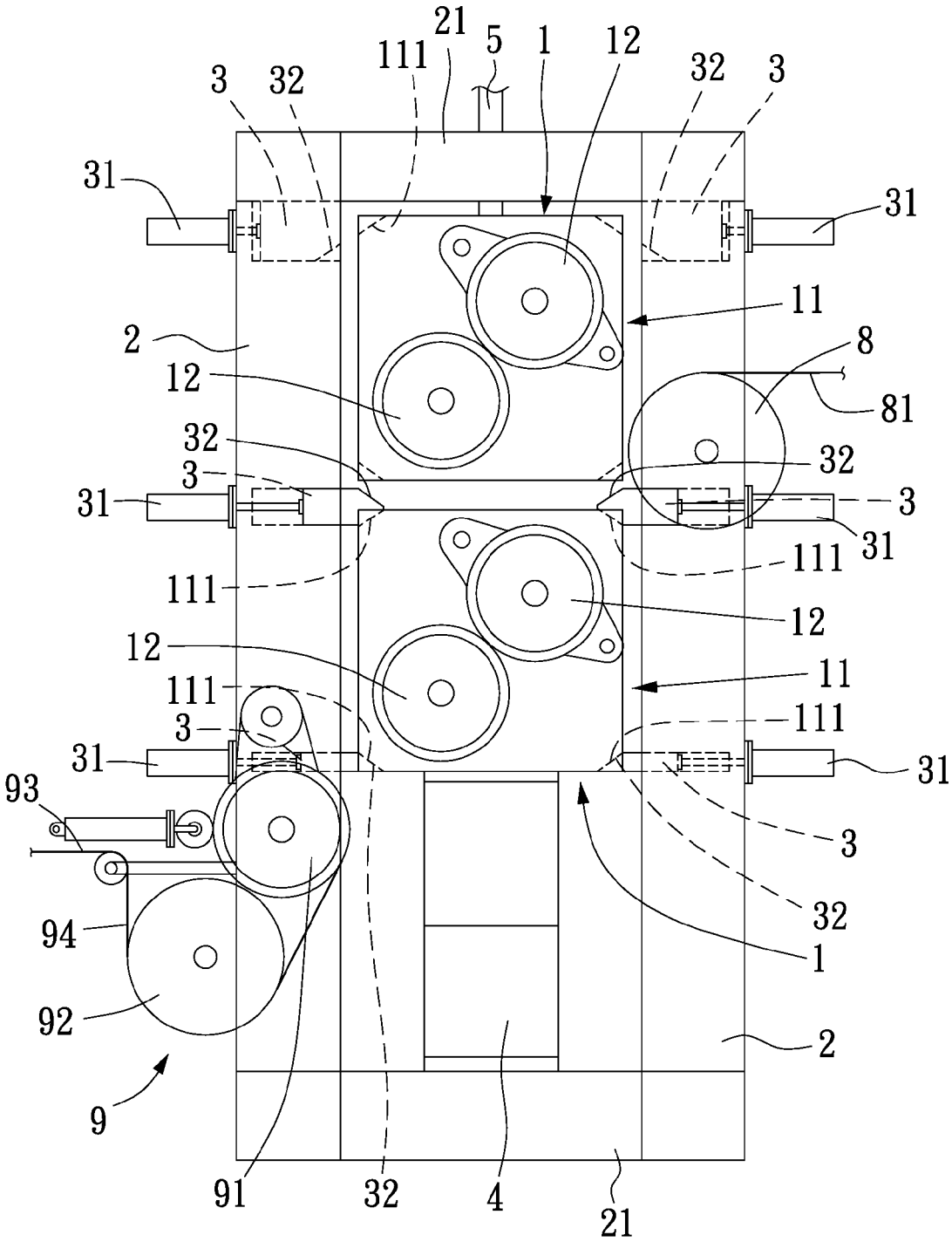
Figure 10:
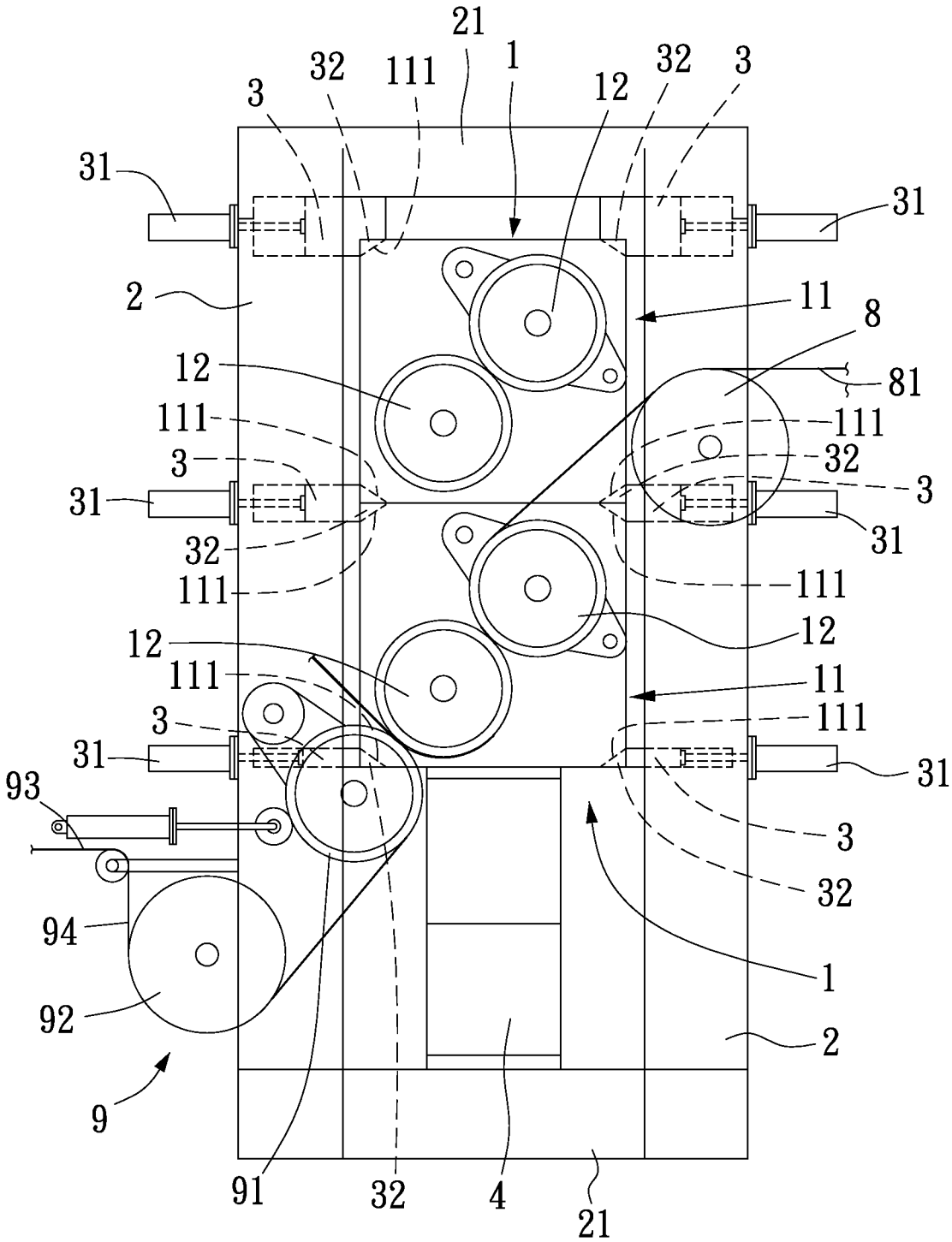

FIGS. 7 to 10 show further steps of using the corrugating roller pair support frame of the present invention. Please refer to FIGS. 7 to 10 along with FIG. 1. As shown, the corrugating roller pair support frame of the present invention is laterally symmetrically configured, and FIGS. 7 to 10 are sectional views taken along a middle position of the support frame of FIG. 1 and viewed from the middle position toward the left side of the support frame. Herein, the support frame will be described with two corrugating roller pairs 1 vertically superposed therein. As shown in FIG. 7, in the event the upper corrugating roller pair 1 in the working zone of the support frame is disordered or when a different type of corrugated board is to be manufactured on the corrugating machine, and it is therefore necessary to replace the upper corrugating roller pair 1 with another one, the first feeding roller 8 and the second feeding roller 91 are caused to stop feeding paper materials, the driving unit 93 of the feeding mechanism 9 drives the second feeding roller 91 to move backward away from the corrugating rollers 12 of the upper corrugating roller pair 1, and all the locating blocks 3 are caused to retract into the supporting posts 2. Then, as shown in FIG. 8, the supporting elevator 4 elevates the two corrugating roller pairs 1, so that the replacing corrugating roller pair 1 at a lower position is now located in the working zone. Further, as shown in FIG. 9, the locating blocks 3 within the working zone are caused to protrude from the supporting posts 2 into the locating slots 111 on the supporting plates 11 of the lower corrugating roller pair 1 that is currently located in the working zone, so that the lower corrugating roller pair 1 is firmly held to the support frame. On the other hand, the upper corrugating roller pair 1 is further hoisted by a hoist 5 and then horizontally moved (perpendicular to the drawing sheet) by a horizontal exchange platform (not shown) to exchange position with another preheated corrugating roller pair 1, which is then moved onto the hoist 5. Thereafter, as shown in FIG. 10, the hoist 5 lowers the new corrugating roller pair 1, all the locating blocks 3 are caused to protrude from the supporting posts 2 to locate and support the two corrugating roller pairs 1, the driving unit 93 of the feeding mechanism 9 drives the second feeding roller 91 to locate closely below the corrugating rollers 12 of the lower corrugating roller pair 1, and the first feeding roller 8 and the second feeding roller 91 start feeding paper materials for manufacturing corrugated board.

With the above arrangements, the support frame of the present invention enables easy and convenient mounting or releasing of the corrugating roller pairs 1 to or from the support frame, so that any one of the corrugating roller pairs 1 can conveniently exchange position with an external third corrugating roller pair 1 to enable manufacturing of a different type of corrugated board or replacement of a failed corrugating roller pair 1 almost without the need of stopping the corrugating machine. That is, any of the corrugating roller pairs 1 can be replaced with a third one without incurring additional loss in time because the replacing corrugating roller pair is already preheated when being mounted to the support frame. Thus, the production of corrugated boards can be performed with shortened time and upgraded efficiency. As can be seen from FIG. 2, with the support frame of the present invention, the first feeding roller 8, the two corrugating rollers 12 of each corrugating roller pair 1, the second feeding roller 91, and the third feeding roller 92 can be arrayed at an angle of 45 degrees relative to the horizontal plane to thereby reduce an overall height of the support frame as well as the heights at which the rollers are mounted, so that less space is needed for the corrugating machine and operators can handle the corrugating roller pairs in a more convenient manner. Moreover, as can be seen from FIG. 3, the support frame of the present invention is so designed that the second feeding roller 91 can be moved backward to a position closer to the supporting posts 2 for easy performing of subsequent operations. Further, as can be seen from FIG. 2, with the support frame of the present invention, the first feeding roller 8 and the feeding mechanism 9 can be exchanged in position to satisfy other required arrangements. And, while the embodiment illustrated in FIGS. 2 to 6 includes two corrugating roller pairs 1, the support frame of the present invention can also be used with only one single corrugating roller pair 1. For example, in the case only one corrugating roller pair 1 is supported by the supporting elevator 4 in FIG. 2 to locate in the working zone, and it is necessary to replace the corrugating roller pair 1 with another one due to disorder of the corrugating roller pair 1 or for the purpose of manufacturing another type of corrugating board, the operator needs only to stop the first feeding roller 8 and the second feeding roller 91 from feeding paper materials, actuate the driving unit 93 of the feeding mechanism 9 to move backward the second feeding roller 91, and retract all the locating blocks 3 into the supporting posts 2. And then, the operator may use the horizontal exchange platform (not shown) to horizontally move the corrugating roller pair 1 (perpendicular to the drawing sheet), so that it exchanges position with another preheated corrugating roller pair 1 and the preheated replacing corrugating roller pair is moved onto the supporting elevator 4. Thereafter, all the locating blocks 3 can be caused to protrude from the supporting posts 2 to engage with the locating slots 111, the driving unit 93 of the feeding mechanism 9 can be actuated to drive the second feeding roller 91 to a position closely below the corrugating rollers 12 of the replacing corrugating roller pair 1, and the first feeding roller 8 and the second feeding roller 91 are caused to feed paper materials again for manufacturing the desired corrugating board.

The corrugating roller pair support frame of the present invention may further include a plurality of driving units 31, which may be air cylinders or oil cylinders and are arranged on the four supporting posts 2 for driving the locating blocks 3 to engage with or disengage from the locating slots 111, so that automated mounting and releasing of the corrugating roller pair 1 to and from the support frame can be achieved.

Figure 11:
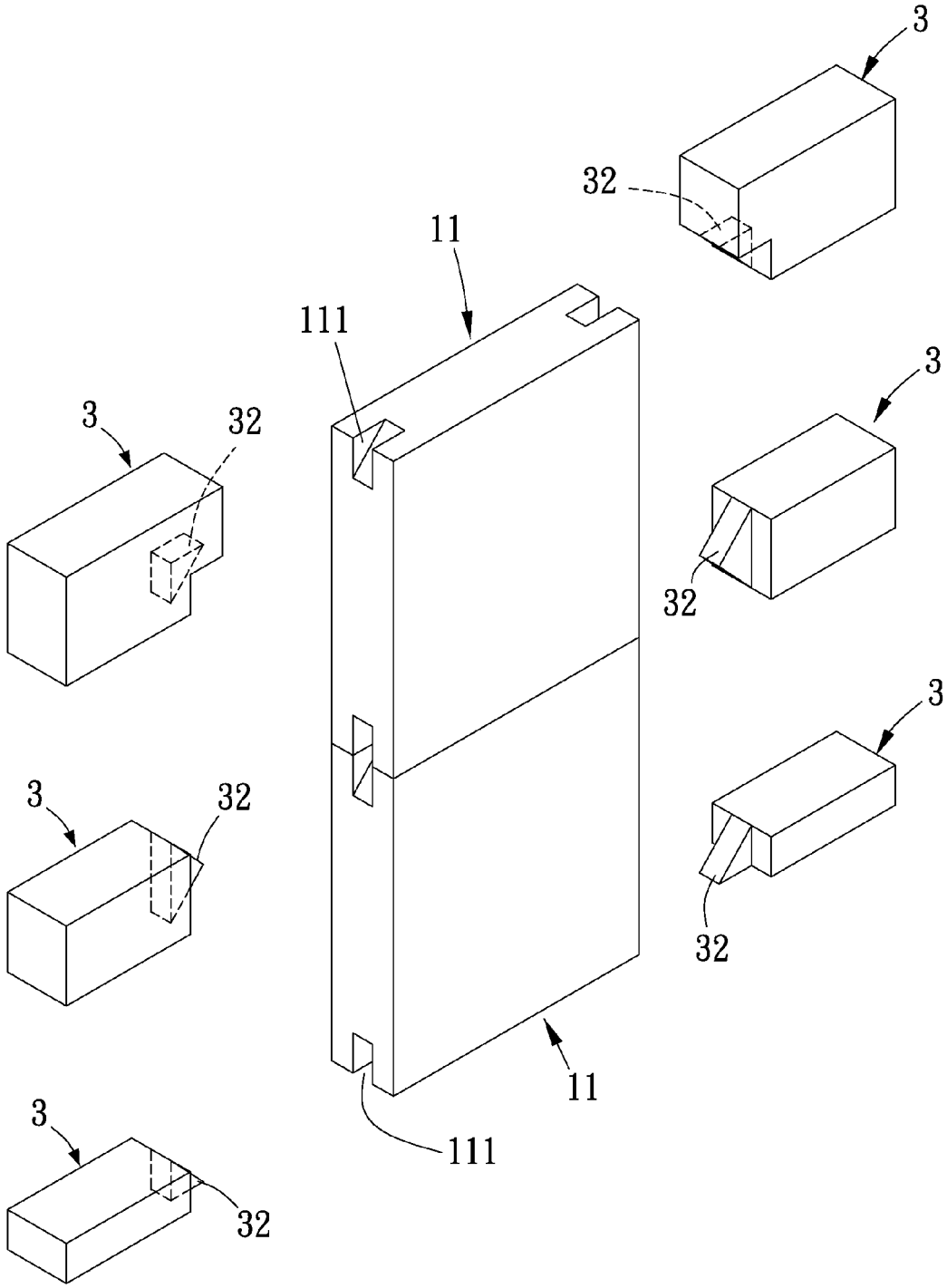
FIG. 11 is an exploded perspective view showing a supporting plate of the corrugating roll pair and some locating blocks for the corrugating roller pair support frame of the present invention.

FIG. 11 is an exploded perspective view showing the supporting plate 11 for the corrugating roller pair 1 and the locating blocks 3 for the support frame of the present invention. As shown, the locating slots 111 provided on the supporting plate 11 are triangular in shape, and the locating blocks 3 respectively have a triangular projection 32 that can be easily guided into the triangular locating slots 111. Through engagement or disengagement of the triangular locating projections 32 with or from the locating slots 111, the corrugating roller pairs 1 are mounted to or released from the support frame of the present invention.

FIG. 12 is a perspective view of the supporting elevator 4 for the support frame of the present invention. As shown, the supporting elevator 4 includes a supporting platform 41 and two crossing supporting legs 42 that are pivotally connected to each other at two intersections thereof, and to a lower side of the supporting platform 41 at their upper ends. When the two crossing legs 42 of the supporting elevator 4 are extended from each other, the supporting platform 41 is lowered; and when the two crossing legs 42 are folded toward each other, the supporting platform 41 is lifted.

Figure 13:
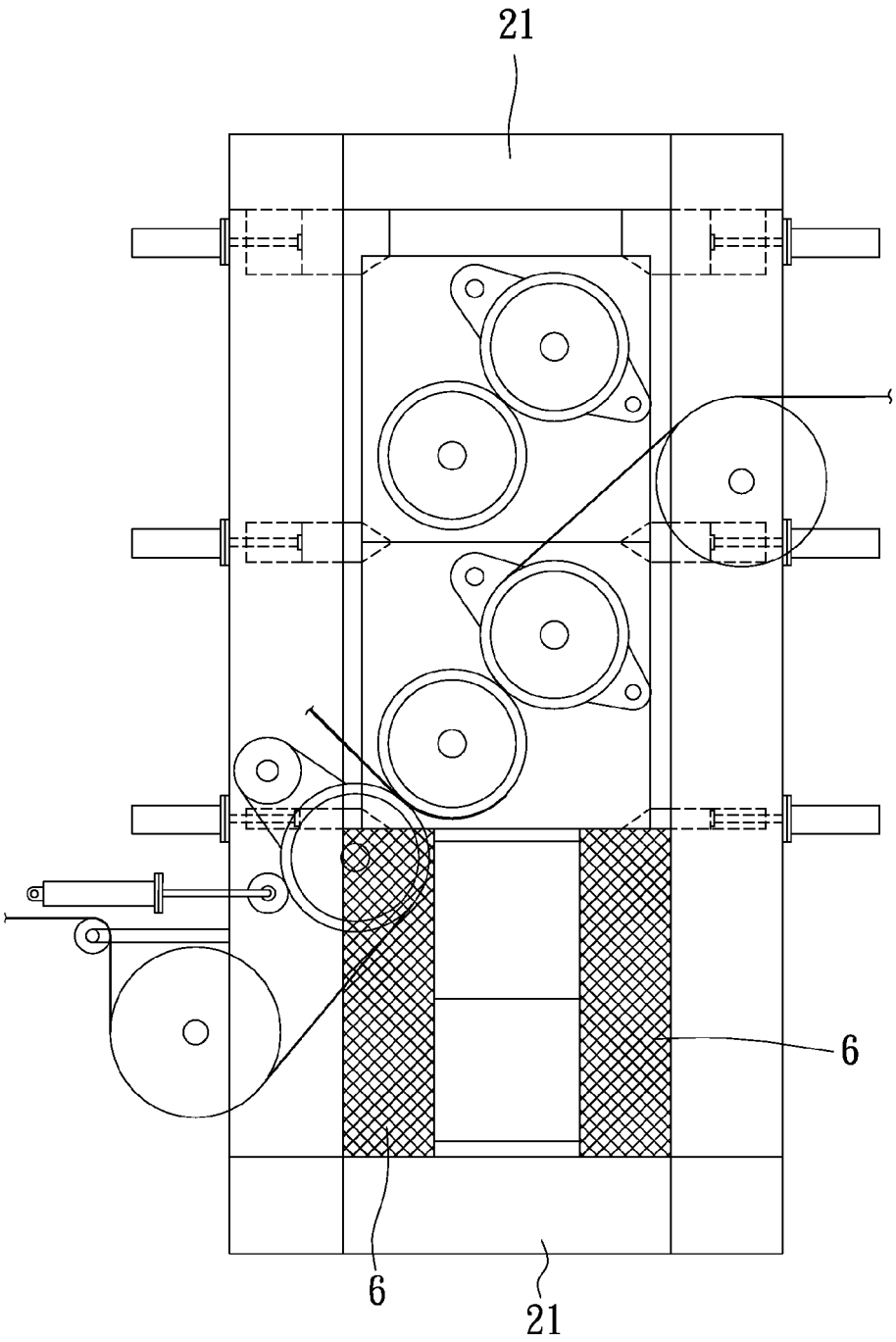
FIG. 13 is a left-side sectional view showing movable door panels for the corrugating roller pair support frame of the present invention.

FIG. 13 is a left-side sectional view showing movable door panels 6 for the corrugating roller pair support frame of the present invention. As shown, the support frame further includes four pieces of movable door panels 6. In FIG. 13, two of the four pieces of movable door panels 6 located at the left side of the support frame are shown. The other two movable door panels 6 for the right side of the support frame are not shown in FIG. 13, but they are symmetrically identical to the two left-side door panels 6. These door panels 6 can be folded up or rolled up to be extendably received in the four supporting posts 2. The movable door panels 6 can be selectively opened or closed between the four supporting posts 2 and the supporting elevator 4. The door panels 6 in the closed position can stop external foreign matters from invading into the corrugating machine to cause undesirable danger.

Figure 14:
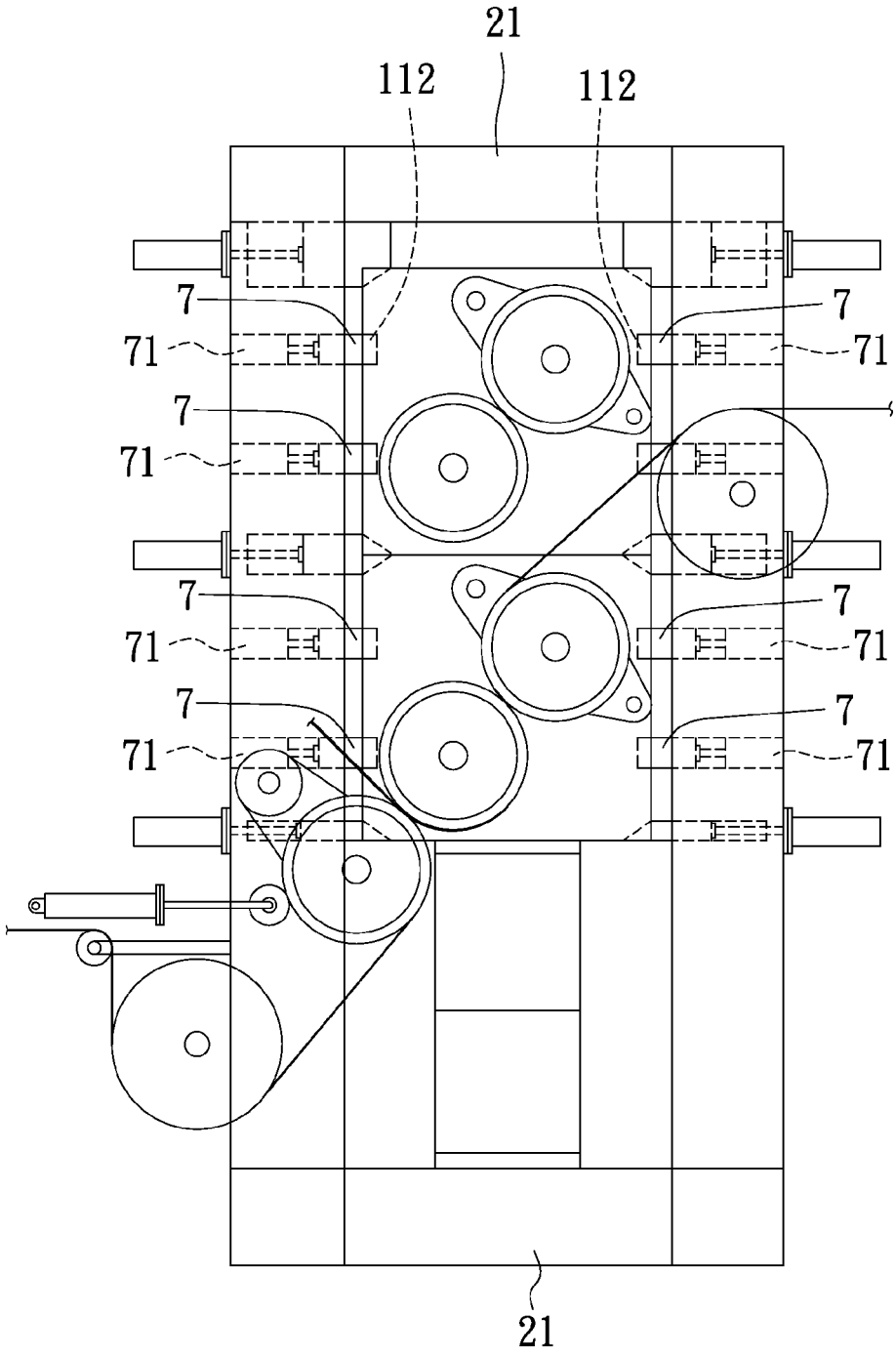
FIG. 14 is a left-side sectional view showing the use of auxiliary locating blocks for the corrugating roller pair support frame of the present invention.
Figure 15:
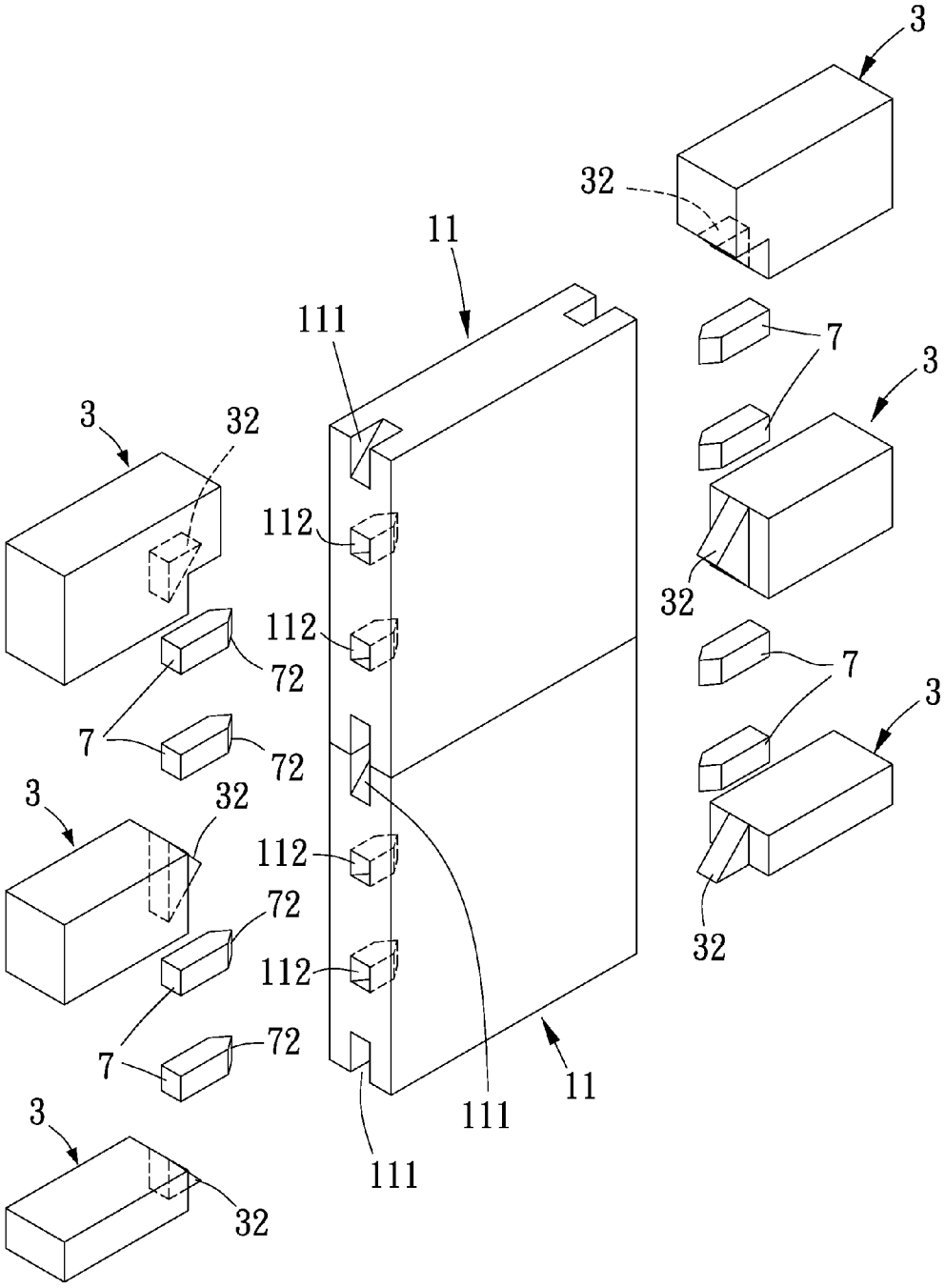
FIG. 15 is an exploded perspective view showing the supporting plate and the locating blocks and auxiliary locating blocks for the present invention.

FIG. 14 is a left-side sectional view of the support frame of the present invention showing a plurality of auxiliary locating blocks 7 for the support frame, and FIG. 15 is an exploded perspective view showing the supporting plate 11, the locating blocks 3 and the auxiliary locating blocks 7. As shown, each of the supporting plates 11 is provided on each of two lateral sides with at least one auxiliary locating slot 112 for assisting in preventing the corrugating roller pairs 1 from moving sidewardly on the support frame. The auxiliary locating slots 112 can be formed in between the two opposite surfaces of the supporting plate 11, or be formed on two in-facing surfaces or two out-facing surfaces of the left and right rectangular supporting plates 11 of the corrugating roller pair 1. And, the four supporting posts 2 are respectively provided with a plurality of movable auxiliary locating blocks 7. When the auxiliary locating blocks 7 engage with the auxiliary locating slots 112 on the rectangular supporting plates 11, the corrugating roller pairs 1 are more firmly held to the support frame. On the other hand, when the auxiliary locating blocks 7 are disengaged from the auxiliary locating slots 112, the corrugating roller pairs 1 can be released from the support frame. When the locating blocks 3 are failed, the auxiliary locating blocks 7 can also serve to hold the corrugating roller pairs 1 to the support frame.

The support frame of the present invention further includes a plurality of auxiliary driving units 71, which can be air cylinders or oil cylinders and arranged on the four supporting posts 2 for driving the auxiliary locating blocks 7 to engage with or disengage from the auxiliary locating slots 112, so that automated auxiliary holding and releasing of the corrugating roller pair 1 to and from the support frame can be achieved.

The auxiliary locating slots 112 are triangular in shape, and the auxiliary locating blocks 7 respectively have an auxiliary triangular projection 72 that can be easily guided into the triangular auxiliary locating slots 112. Through engagement or disengagement of the auxiliary triangular locating projections 72 with or from the auxiliary locating slots 112, the corrugating roller pairs 1 can be more safely mounted to or released from the support frame of the present invention.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A corrugating roller pair support frame for at least one corrugating roller pair of a corrugating machine to releasably mount thereon, the corrugating roller pair including two rectangular supporting plates and two corrugating rollers, the two corrugating rollers being arranged side by side and rotatably connected to between the two rectangular supporting plates, and the two rectangular supporting plates being respectively formed on each of two lateral sides with at least one locating slot; the support frame comprising:

four supporting posts, in between two of which one of the two rectangular supporting plates of the corrugating roller pair is mounted while the other rectangular supporting plate is mounted in between the other two supporting posts; the four supporting posts having a plurality of locating blocks movably embedded therein for releasably engaging with the locating slots formed on the rectangular supporting plates, such that the corrugating roller pair is fixedly mounted on the support frame when the locating blocks are engaged with the locating slots or is released from the support frame when the locating blocks are disengaged from the locating slots; and a supporting elevator for supporting the corrugating roller pair thereon and regulating a height at which the corrugating roller pair is mounted to the support frame.

2. The corrugating roller pair support frame as claimed in claim 1, further comprising a plurality of driving units mounted on the supporting posts for driving the locating blocks to engage with or disengage from the locating slots, so as to mount or release the corrugating roller pair to or from the support frame.

3. The corrugating roller pair support frame as claimed in claim 1, wherein the locating slots are triangular in shape, and the locating blocks respectively have a triangular projection; and the triangular projections being engaged with or disengaged from the triangular locating slots to mount or release the corrugating roller pair to or from the support frame.

4. The corrugating roller pair support frame as claimed in claim 1, further comprising four movable door panels movably mounted to the four supporting posts, such that the four movable door panels can be selectively opened or closed between the four supporting posts and the supporting elevator.

5. The corrugating roller pair support frame as claimed in claim 1, wherein the rectangular supporting plates are respectively formed on each of two lateral sides with at least one auxiliary locating slot, and the four supporting posts have a plurality of auxiliary locating blocks movably embedded therein for releasably engaging with the auxiliary locating slots formed on the rectangular supporting plates, so as to assist in mounting or releasing the corrugating roller pair to or from the support frame through engagement or disengagement of the auxiliary locating blocks with or from the auxiliary locating slots.

6. The corrugating roller pair support frame as claimed in claim 5, further comprising a plurality of auxiliary driving units mounted on the supporting posts for driving the auxiliary locating blocks to engage with or disengage from the auxiliary locating slots, so as to assist in mounting or releasing the corrugating roller pair to or from the support frame.

7. The corrugating roller pair support frame as claimed in claim 5, wherein the auxiliary locating slots are triangular in shape, and the auxiliary locating blocks respectively have an auxiliary triangular projection; and the auxiliary triangular projections engaging with or disengaging from the triangular auxiliary locating slots to assist in mounting or releasing the corrugating roller pair to or from the support frame.

* * * * *